US011466539B2

(12) United States Patent
Howitt

(10) Patent No.: US 11,466,539 B2
(45) Date of Patent: Oct. 11, 2022

(54) PACKER SUB WITH CHECK VALVE

(71) Applicant: Halliburton Energy Services, Inc., Houston, TX (US)

(72) Inventor: Garry Martin Howitt, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/187,779

(22) Filed: Feb. 27, 2021

(65) Prior Publication Data

US 2022/0275704 A1 Sep. 1, 2022

(51) Int. Cl.
*E21B 34/08* (2006.01)
*E21B 33/128* (2006.01)

(52) U.S. Cl.
CPC ..... *E21B 34/08* (2013.01); *E21B 33/128* (2013.01)

(58) Field of Classification Search
CPC ..... E21B 34/08; E21B 33/128; E21B 33/1294
See application file for complete search history.

(56) References Cited

U.S. PATENT DOCUMENTS 3,974,878 A 8/1976 Roeder
5,577,560 A 11/1996 Coronado
6,315,041 B1 * 11/2001 Carlisle ..... E21B 33/1295 166/212
8,113,274 B2 2/2012 Rivas
8,851,166 B2 10/2014 Foubister et al.
10,378,322 B2 8/2019 Ejim
2010/0212895 A1 * 8/2010 Vickery ..... E21B 43/12 166/278
2016/0376880 A1 * 12/2016 Vasques ..... E21B 34/14 166/250.01
2019/0226308 A1 * 7/2019 Konopczynski ..... E21B 33/138
(Continued)

FOREIGN PATENT DOCUMENTS

CN 206458429 U 9/2017
CN 206957669 U 2/2018
(Continued)

OTHER PUBLICATIONS

DIPL.-ING. Ralph Stephan, BSC., Screening Possible Applications of Electrical Submersible Pumps Technology within Changing Gas Oil Ratio Regimes, Jan. 21, 2014.
(Continued)

*Primary Examiner* — David Carroll
(74) *Attorney, Agent, or Firm* — K&L Gates LLP

(57) ABSTRACT

A work string locatable in a borehole so as to form an annulus around the work string and a method of depressurizing the annulus are provided. The work string includes a packer expandable radially out from the work string to seal the annulus and a packer sub positioned below the packer including a sub body and a check valve in the body and operable to permit fluid in the annulus to flow into the work string and prevent fluid in the work string from flowing into the annulus. The check valve is operable to open and permit fluid in the annulus to flow into the work string upon exertion of a predetermined minimum pressure on the check valve by the fluid in the annulus. The method includes providing the work string in the borehole and depressurizing the annulus by permitting fluid in the annulus to flow through the check valve.

20 Claims, 4 Drawing Sheets

(56) References Cited

U.S. PATENT DOCUMENTS

| | | | | |
|---|---|---|---|---|
| 2019/0264518 | A1 | 8/2019 | Al-gouhi | |
| 2019/0284898 | A1 | 9/2019 | Fagna | |
| 2020/0370395 | A1* | 11/2020 | Sladic | E21B 43/08 |

FOREIGN PATENT DOCUMENTS

| | | | |
|---|---|---|---|
| EP | 3115546 | A1 | 1/2017 |
| RU | 2715008 | C1 | 2/2020 |

OTHER PUBLICATIONS

International Search Report and Written Opinion dated Nov. 22, 2021 for corresponding PCT Application No. PCT/US2021/020149 filed on Feb. 28, 2021.

* cited by examiner

PACKER SUB WITH CHECK VALVE

BACKGROUND

This section is intended to provide relevant background information to facilitate a better understanding of the various aspects of the described embodiments. Accordingly, these statements are to be read in this light and not as admissions of prior art.

In the drilling and completion of oil and gas wells, it is often desirable to selectively seal or plug the well at one or more locations during the production of hydrocarbons from the well. A packer can provide hydraulic isolation of zones within the well for sequential operations in one zone while isolating already treated zones. For example, open-hole packers can be used to provide a seal in the annulus between the earthen sidewall of the borehole and a tubular (such as a work string). Similarly, cased-hole packers can be used to provide a seal in an annulus between an outer tubular (such as a borehole casing) and an internal tubular (such as a work string).

Once a work string and packer have been installed in the borehole, formation fluids tend to accumulate at high pressure underneath the packer in the annulus between the casing inner diameter and work string outer diameter. When retrieving the work string, and particularly when removing the packer from the borehole, the pressurized fluid can cause a well kick due to the sudden pressure drop within the well once the packer is broken or the packer is removed from the well when tripping out. A kick can lead to blowout wherein fluids erupt from the well, causing extensive equipment damage and safety issues. Kicks thus may cause operators to shut in and kill the well to prevent blowout.

During circulation treatments when the packer is downhole, fluids may be circulated through the work string below the packer. The circulation fluid must not escape the work string and prematurely enter the annulus. Such fluids should desirably circulate below the packer and possibly to the full depth of the work string before exiting the work string and entering the annulus.

A need therefore exists for a packer sub that can allow pressurized fluids in the annulus to enter the work string while preventing fluids from exiting the work string prematurely.

BRIEF DESCRIPTION OF THE DRAWINGS

Embodiments of a work string with a packer sub are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a work string locatable in a borehole so as to form an annulus around the work string. The work string includes a packer expandable radially out from the work string to seal the annulus and a packer sub positioned below the packer. The packer sub includes a sub body and a check valve in the body and operable to permit fluid in the annulus to flow into the work string and prevent fluid in the work string from flowing into the annulus. The check valve is operable to open upon exertion of a predetermined minimum pressure on the check valve by the fluid in the annulus. The present disclosure further describes a method of depressurizing an annulus in a borehole of a well. The method includes providing the work string in the borehole and depressurizing the annulus by permitting fluid in the annulus to flow through the check valve upon the fluid exerting a predetermined minimum pressure on the check valve.

The term "casing" or "liner" indicates tubing that is used to line or otherwise provide a barrier along a wellbore wall. Such casings may be fabricated from composites, metals, plastics, or any other suitable material.

The term "check valve" indicates a valve having two or more open ends that allows fluid flow through the valve in one direction while preventing fluid flow through the valve in the opposite direction.

The term "formation fluid" indicates a fluid originating from the subterranean formation. Formation fluids can be liquid or gas and can migrate within or out of the subterranean formation, for example migrating into the annulus and accumulating below a packer.

A fluid described herein as circulating to "full depth" flows down into the borehole through the work string and passes through the packer and packer sub without flowing out through the check valve. Fluids circulated at depth do not enter the annulus via the check valve, but instead flow through the packer sub and then out of the work string at a location below the packer sub and into the annulus. The circulating fluids may circulate down to the full depth of the work string before exiting the work string or to the full depth of a vertical section of the work string before exiting that vertical section.

The term "kill weight fluid" or "kill weight mud" indicates a fluid having a sufficiently high density to create a column of kill weight fluid with hydrostatic pressure capable of overcoming the reservoir pressure during a well kick and thus killing the well.

Figure 1:
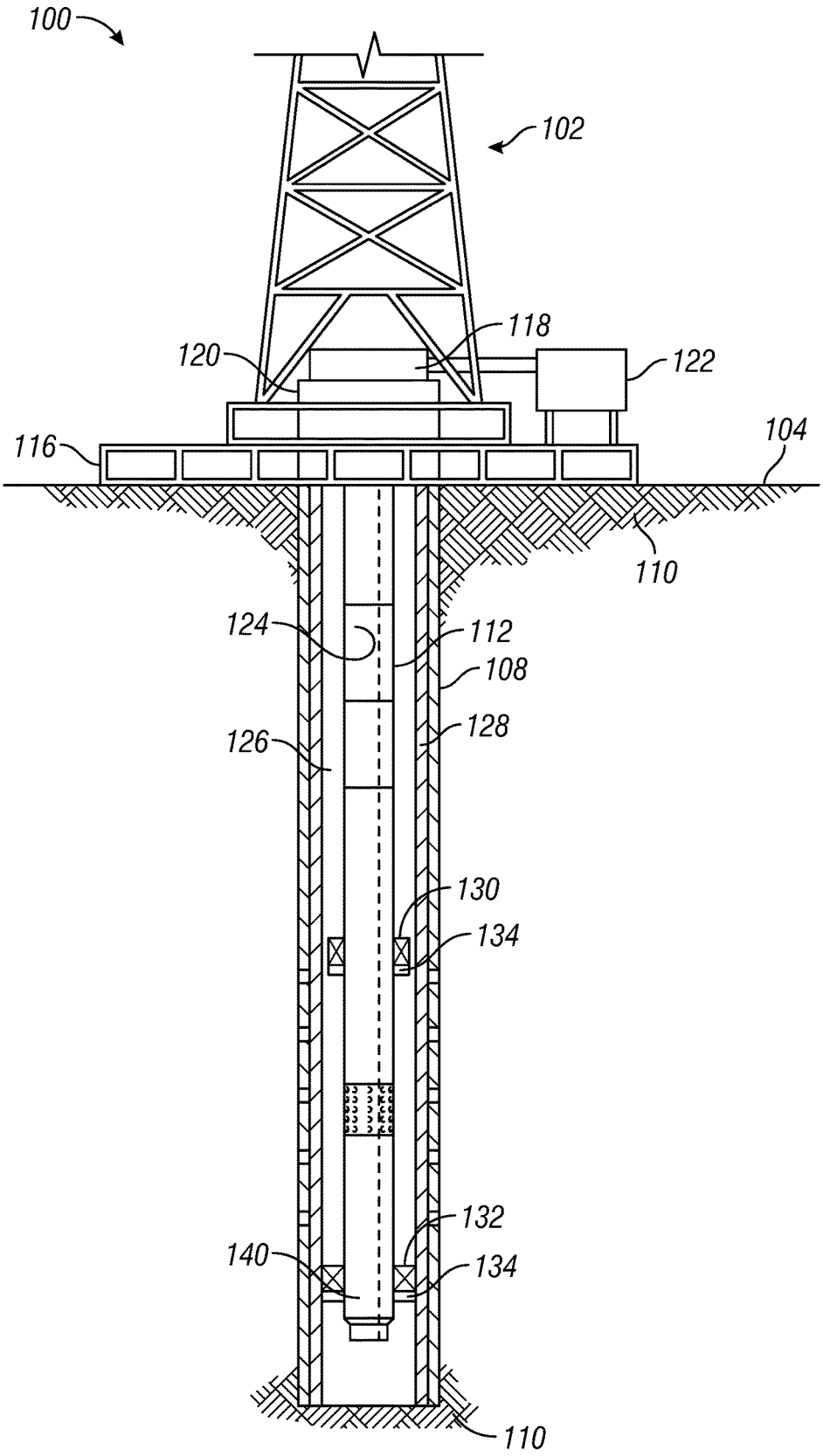
FIG. 1 is a schematic diagram of a well system.

Turning now to the figures, FIG. 1 is a schematic view of a well system 100. The well system includes a rig 102 atop a surface 104 of a well 106. Beneath the rig 102, a borehole 108 is formed within a subterranean formation 110, which is expected to produce hydrocarbons. The borehole 108 may be formed in the subterranean formation 110 using a drill string that includes a drill bit to remove material from the subterranean formation 110. The borehole 108 of FIG. 1 is shown as being vertical, but can be formed at any suitable angle to reach a hydrocarbon-rich portion of the subterranean formation 110. The borehole 108 can follow a vertical path, an angled path, a horizontal path, or any combination thereof through the subterranean formation 110.

A work string 112 is deployed from the rig 102, which can be a drilling rig, a completion rig, a workover rig, or another type of rig. The rig 102 includes a derrick 114 and a rig floor 116. The work string 112 extends downward through the rig floor 116, through a fluid diverter 118 and a blowout preventer 120 and into the borehole 108 and subterranean formation 110. The fluid diverter 118 and blowout preventer 120 provide a fluidly sealed interface between the borehole 108 and external environment. The work string 112 is disposed in the borehole 108 and separated from the borehole 108, forming an annulus 126 around the work string 112. The work string 112 is shown in installed position in FIG. 1. However, prior to or following installation, the well system 100 may also include a motorized winch and other equipment for extending the work string 112 into the borehole 108, retrieving the work string 112 from the borehole 108, positioning the work string 112 at a selected depth within the borehole 108, or for lowering diagnostic, repair, or other equipment into the work string 112 by wireline or slickline, for example.

A pump 122 is coupled to the fluid diverter 118. The pump 122 is operable to deliver or receive fluid through a fluid bore 124 of the work string 112 by applying a positive or negative pressure to the fluid bore 124. The fluid bore 124 is the flow path of fluid from an inlet of the work string 112 to the surface 104. The pump 122 may also deliver positive or negative pressure through the annulus 126 surrounding the work string 112. The annulus 126 can be between the wall of the borehole 108 and exterior of the work string 112. If the borehole 108 is lined with a casing 128, the annulus 126 is between the work string 112 and the casing 128. Fluid entering the borehole 108 from the surface 104 flows down the work string 112 and through the tailpipe 140 and out into the annulus 126.

Following formation of the borehole 108, the work string 112 may be equipped with tools and deployed within the borehole 108 to prepare, operate, or maintain the well 106. Specifically, the work string 112 may incorporate tools that are actuated after deployment in the borehole 108, including without limitation bridge plugs, composite plugs, cement retainers, high expansion gauge hangers, straddles, or packers. Actuation of such tools may result in centering the work string 112 within the borehole 108, anchoring the work string 112, isolating a segment or zone of the borehole 108 from other segments or zones, or other functions related to positioning and operating the work string 112.

As shown in FIG. 1, the work string 112 includes one or more packers 130, 132. The packers 130, 132 expand radially out from the work string 112 to seal the annulus 126, such as by engaging the casing 128 or the wall of the borehole 108 in an open hole section. Packers 130, 132 are typically used to prepare the borehole 108 for hydrocarbon production (e.g., fracturing) or for service during formation (e.g., acidizing or cement squeezing). In FIG. 1, an upper packer 130 is shown in run-in position and the lower packer 132 is shown in an expanded position to form a seal against the wall of the borehole 108 and the work string 112 to prevent fluids from the subterranean formation 110 below the packers 130, 132 from interacting with the work string 112. The packers 130, 132 can be bridge plugs 130, 132. The packers 130, 132 can be retrievable packers 130, 132, or can be long term suspension packers 130, 132, or can be permanent packers 130, 132.

Figure 2:
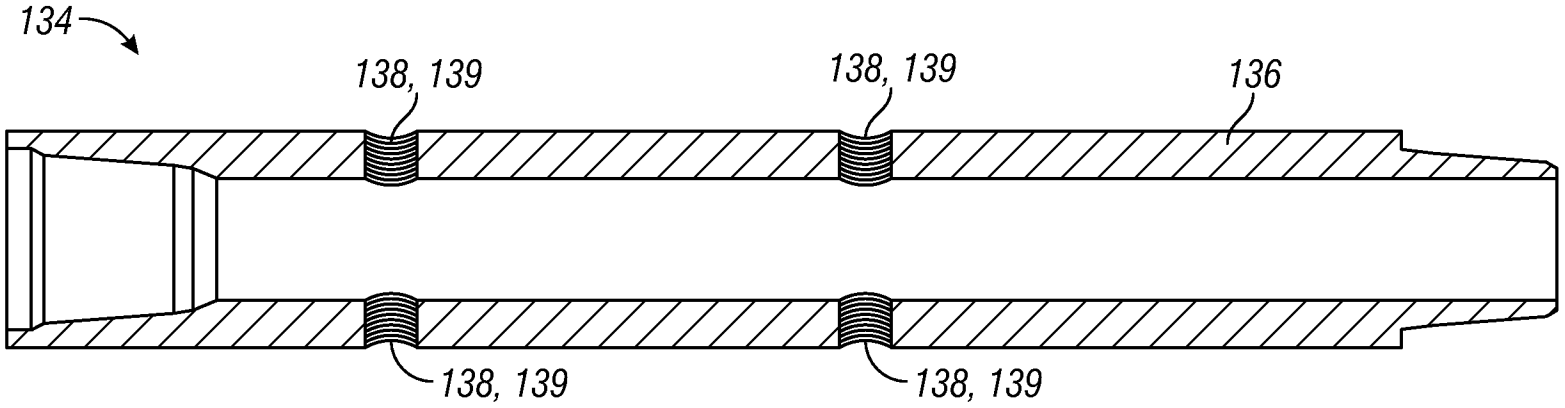
FIG. 2 is a diagram of a packer sub with threaded ports.
Figure 3:
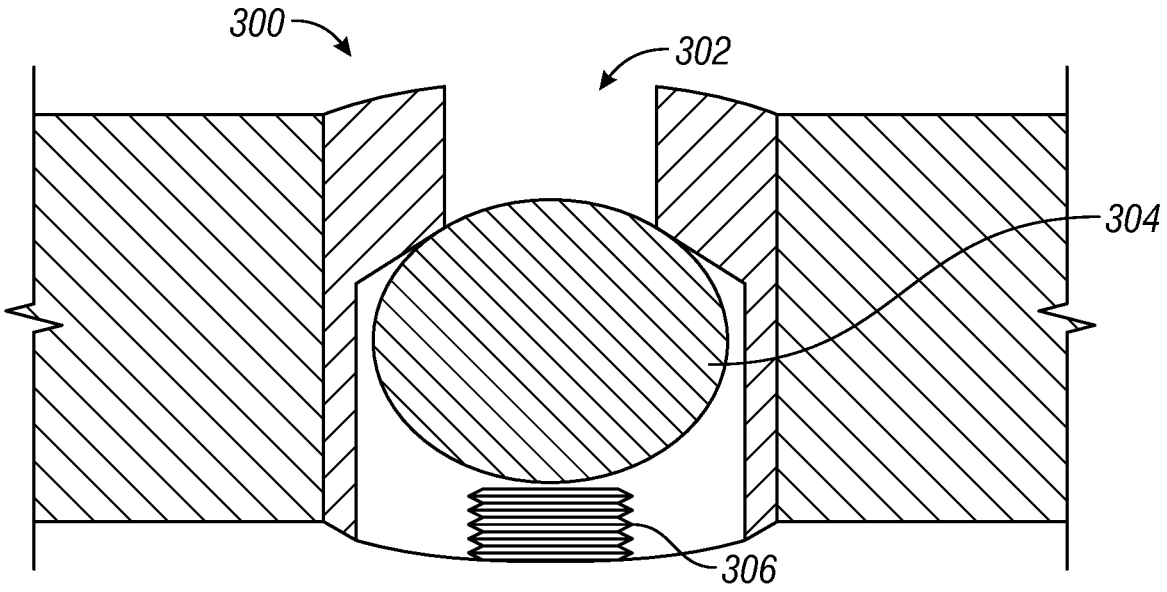
FIG. 3 is a diagram of a ball check valve.

As shown in FIGS. 1-3, the work string 112 also includes packer subs 134 positioned below the packers 130, 132. Each packer sub 134 includes a sub body 136 and one or more check valves 138 in the sub body 136 and operable to open and permit fluid in the annulus 126 to flow into the work string 112 and prevent fluid in the work string 112 from flowing into the annulus 126. The check valve 138 establishes a one-way flow system of fluid circulating within the work string 112. Particularly, the fluid in the annulus 126 can flow through the check valve 138 into an inner diameter of the work string 112. Each check valve 138 is operable to open upon exertion of a predetermined minimum pressure on the check valve 138 by the fluid in the annulus 126. The predetermined minimum pressure can be between about 15 and about 500 psi, between about 15 and about 350 psi, or between about 15 and about 200 psi.

After fluid in the annulus 126 has migrated into the inner diameter of the work string 112, the fluid can be removed from the borehole 108. The fluid in the work string 112 can be removed by extracting the fluid at the surface 104. The fluid in the work string can alternatively be removed from the borehole 108 by circulating a circulation fluid down through the work string 112 through the tailpipe 140 and into the annulus 126. Such circulation pushes the formation fluid out of the annulus 126 and into the subterranean formation 110.

The check valves 138 may be installed in the packer sub body 136 by threading into threaded ports 139 as shown in FIG. 2. The check valves 138 may be selected from the group consisting of a ball check valve, a poppet valve, and a diaphragm check valve. As an example, a check valve 138 may be a ball check valve 300 as shown in FIG. 3. The ball check valve 300 comprises a spring 306 pressing a sealing ball 304 against a valve seat to close the valve. When the sealing ball 304 is pressed into in the spring 306, the flow port 302 is opened and fluid can flow through the flow port 302 and thus pass through the ball check valve 300. When the sealing ball 304 is seated against the valve seat, the flow port 302 is blocked and fluid flow through the flow port 302 is prevented. The spring 306 has a resistance corresponding to a predetermined minimum pressure, such that a fluid exerting the predetermined minimum pressure presses the sealing ball 304 into the spring 306 and opens the flow port 302, allowing the fluid to flow through the ball check valve 300.

The work string 112 can include at least two packers 130, 132 to isolate and seal vertical sections of the borehole 108. Isolated vertical sections of the borehole 108 can thereafter be targeted individually with circulation treatments. For such circulation treatments, it may be desirable to configure the check valve 138 to permit fluid flow either from the annulus 126 into the work string 112 or from the work string 112 into the annulus 126, depending on the envisioned application. The one-directional nature of the check valve 138 allows circulation treatments in a vertical section to be performed in a specific direction or at a specific pressure.

The check valve 138 facilitates circulation to the full depth of the work string 112. In a circulation treatment, a circulation fluid is directed down the work string 112. The packer sub 134 and one-directional check valve 138 force the circulation fluid to circulate to full depth by preventing the fluid from exiting the work string 112 and entering the annulus 126 prematurely. The circulation fluid is blocked from entering the annulus 126 through the packer sub 134 and instead circulates past the tailpipe 140 to the deepest point of the work string 112 before exiting the work string 112 and entering the annulus 126.

Figure 4:
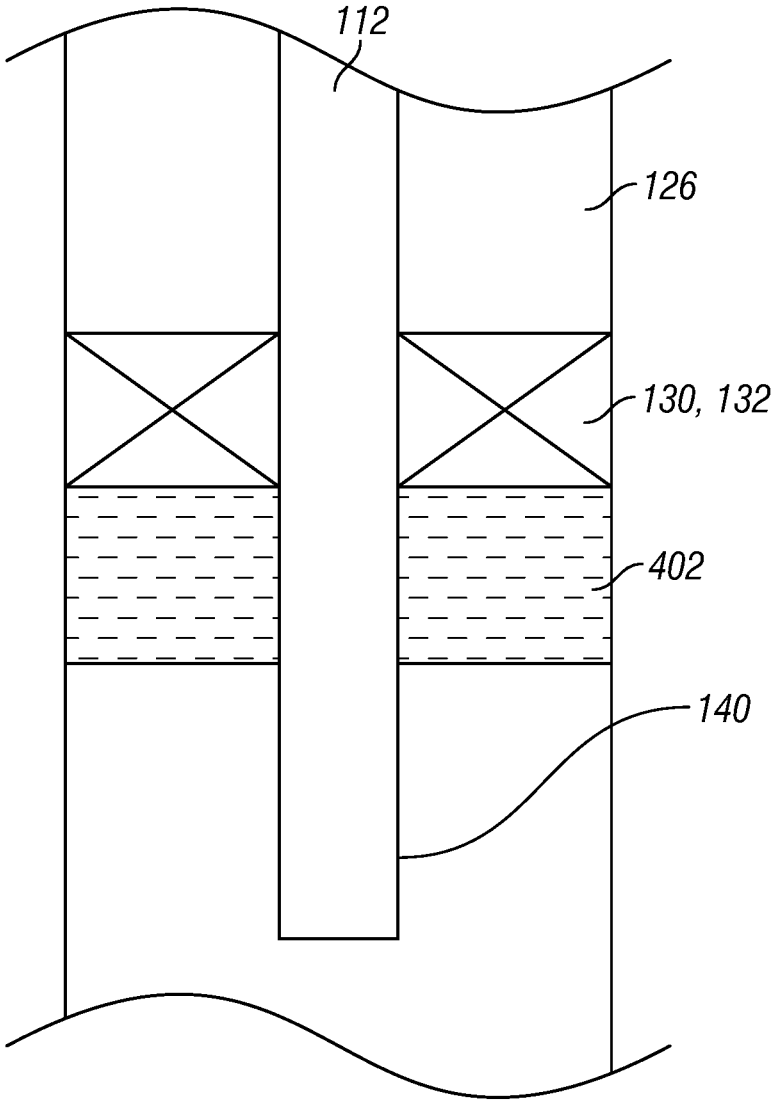
FIG. 4 is a diagram showing fluids in an annulus accumulated underneath a packer.

As shown in FIG. 4, fluid 402 accumulates in the annulus 126 below the packer 130, 132. Once the packer 130, 132, is set in place downhole, formation fluid 402 that would otherwise migrate up the annulus is blocked by and accumulates under the packer 130, 132. Such formation fluid 402 can be liquid or gas, such as crude oil or natural gas. The check valve 138 allows for bleeding off formation fluid 402 and thus depressurizing of the annulus 126 while also facilitating full depth circulation.

Applications

The packer sub and check valve are broadly applicable to wells where fluid in the annulus accumulates and where circulation in a specific direction or at specific pressure is desired. Fluids accumulate at high pressure in the annulus underneath the packer. If the packer is removed or the seal is otherwise broken while the annulus is pressurized, the resulting pressure differential can cause an influx of high pressure formation fluid into the low pressure reservoir, i.e. a well kick. By allowing depressurization of the formation fluid, the packer sub and check valve prevent such well kicks.

The work string is removed during abandonment of the well. The work string including the packer and packer sub is initially set in place within the borehole before resource production begins. When abandoning the well, the work string must be removed before the well can be plugged and abandoned. The work string is pulled up to the surface and removed from the well. The work string, packer, and packer sub cannot be safely removed while highly pressurized fluids persist in the annulus or work string.

A control valve within the work string is positioned in line with each packer. The packer expands radially outward to create a seal separating vertical sections of the annulus. When closed, the control valve creates a seal separating vertical sections within the inner diameter of the work string. Together, the seals provided by the packer and the control valve form a seal across the diameters of the work string and annulus, effectively isolating vertical sections of the borehole. When the control valve is opened and the seal within the inner diameter of the work string is broken, fluid communication is established between previously isolated vertical sections of the work string. Fluid in the annulus can flow into the work string below the packer at any point where the fluid pressure overcomes the check valve. However, fluid that has entered the work string can only be removed from the work string while the control valve is opened and fluid communication is established.

Once the pressurized fluids in the annulus are safely bled off, the work string can be removed from the borehole. The control valve includes a release mechanism, allowing a portion of the work string above the packer and control valve to be removed when the control valve is closed and the portion of the work string below the packer and control valve is sealed. Where the work string includes multiple packers, vertical sections of the work string can be sequentially removed from the borehole in such a manner.

The packer sub and check valve further encourage full depth circulation of circulation and allow pressure and direction control during circulation treatments. A contemplated circulation treatment is a well kill, wherein a well kick occurs and the well is shut in and subsequently killed in response to the kick. In such applications the circulation fluid is a kill weight fluid.

In response to a well kick, a well can be shut in. A shut-in procedure typically includes raising up tools, stopping pumps, closing the choke and blowout preventer, and recording data for kill weight calculations. Details of the shut-in procedure are dependent on the well environment and current operations being performed. The shut-in can be a hard shut-in or a soft shut-in. In a soft shut-in, the choke manifold remains open until after the blowout preventer is closed.

After the well is shut-in, the well can be killed by circulating a kill weight fluid. Data collected by operators including shut-in drill pipe pressure, shut-in casing pressure, and pit gain are used to calculate the required density of the kill weight fluid. The kill weight fluid can be prepared by mixing mud with weighting materials such as barite or hematite to increase the density of the kill weight fluid. The well can be killed by forward or reverse circulation. In forward circulation, the circulation fluid is pumped down into the work string, flows through the tailpipe, exits the work string, and circulates throughout the annulus. In forward circulation treatments, the packer sub and check valve can be configured to permit fluid flow from the annulus to the work string while preventing fluid flow from the work string to the annulus, which forces the circulation fluid to circulate to full depth before exiting the work string. In reverse circulation, the circulation fluid is pumped down into the annulus, and then circulates upward throughout the work string. In reverse circulation treatments, the packer sub and check valve can be configured to permit fluid flow from the work string to the annulus while preventing fluid flow from the annulus to the work string, which forces the circulation fluid to circulate to full depth before entering the work string. Circulation treatments can be performed individually on isolated vertical sections of the borehole.

Examples of the above embodiments include:

Example 1 is a work string locatable in a borehole so as to form an annulus around the work string, comprising: a packer expandable radially out from the work string to seal the annulus; and a packer sub positioned below the packer and comprising a sub body and a check valve in the body and operable to permit fluid in the annulus to flow into the work string and prevent fluid in the work string from flowing into the annulus; wherein the check valve is operable to open and permit fluid in the annulus to flow into the work string upon exertion of a predetermined minimum pressure on the check valve by the fluid in the annulus.

In Example 2, the embodiments of any preceding paragraph or combination thereof further include the work string of Example 1, wherein the packer is a retrievable packer.

In Example 3, the embodiments of any preceding paragraph or combination thereof further include the work string of Example 1, wherein the packer is a long term suspension packer.

In Example 4, the embodiments of any preceding paragraph or combination thereof further include the work string of Example 1, wherein the work string comprises at least two packers to isolate a vertical section of the borehole.

In Example 5, the embodiments of any preceding paragraph or combination thereof further include the work string of Example 1, wherein the check valve is selected from the group consisting of a ball check valve, a poppet valve, and a diaphragm check valve.

In Example 6, the embodiments of any preceding paragraph or combination thereof further include the work string of Example 1, wherein the predetermined minimum pressure is between about 15 and about 500 psi.

In Example 7, the embodiments of any preceding paragraph or combination thereof further include the work string of Example 1, wherein the check valve is operable to prevent a circulation fluid in the work string from flowing into the annulus such that the circulation fluid circulates in the work string below the packer sub.

Example 8 is a method of depressurizing an annulus in a borehole of a well comprising: providing a work string in the borehole so as to form the annulus around the work string; and depressurizing the annulus by permitting fluid in the annulus to flow through a check valve in a sub body of a packer sub below a packer into the work string upon the fluid in the annulus exerting a predetermined minimum pressure on the check valve.

In Example 9, the embodiments of any preceding paragraph or combination thereof further include the method of Example 8, further comprising removing the fluid in the work string from the borehole by extracting the fluid at the surface.

In Example 10, the embodiments of any preceding paragraph or combination thereof further include the method of Example 8, further comprising removing the fluid in the work string from the borehole by circulating a circulation fluid down through the work string below the packer sub and into the annulus.

In Example 11, the embodiments of any preceding paragraph or combination thereof further include the method of Example 10, further comprising forcing the circulation fluid to circulate in the work string below the packer sub by preventing the circulation fluid from flowing from the work string into the annulus through the check valve.

In Example 12, the embodiments of any preceding paragraph or combination thereof further include the method of Example 11, wherein the circulation fluid is a kill weight fluid.

In Example 13, the embodiments of any preceding paragraph or combination thereof further include the method of Example 8, further comprising removing the work string from the borehole.

In Example 14, the embodiments of any preceding paragraph or combination thereof further include the method of Example 8, further comprising shutting in the well.

In Example 15, the embodiments of any preceding paragraph or combination thereof further include the method of Example 8, further comprising killing the well with a kill weight fluid.

In Example 16, the embodiments of any preceding paragraph or combination thereof further include the method of Example 8, wherein the predetermined minimum pressure is between about 15 and about 500 psi.

Example 17 is a packer sub locatable in a borehole so as to form an annulus around the packer sub, the packer sub comprising a sub body and a check valve in the sub body and operable to permit fluid in the annulus to flow into the packer sub and prevent fluid in the packer sub from flowing into the annulus, wherein the check valve is operable to open and permit fluid in the annulus to flow into the packer sub upon exertion of a predetermined minimum pressure on the check valve by the fluid in the annulus.

In Example 18, the embodiments of any preceding paragraph or combination thereof further include the packer sub of Example 17, wherein the check valve is selected from the group consisting of a ball check valve, a poppet valve, and a diaphragm check valve.

In Example 19, the embodiments of any preceding paragraph or combination thereof further include the packer sub of Example 17, wherein the predetermined minimum pressure is between about 15 and about 500 psi.

In Example 20, the embodiments of any preceding paragraph or combination thereof further include the packer sub of Example 17, wherein the check valve is configured to prevent a circulation fluid in the packer sub from flowing through the check valve such that the circulation fluid circulates below the packer sub.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

While compositions and methods are described herein in terms of "comprising" various components or steps, the compositions and methods can also "consist essentially of" or "consist of" the various components and steps.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques accepted by those skilled in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A work string locatable in a borehole so as to form an annulus around the work string, comprising:

a packer expandable radially out from the work string to seal the annulus; and a packer sub positioned below the packer and comprising a sub body and a biased check valve in the body and operable to permit fluid in the annulus to flow into the work string and prevent fluid in the work string from flowing into the annulus;

wherein the check valve is operable to open against a bias and permit fluid in the annulus to flow into the work string without fluid type differentiation upon exertion of a predetermined minimum pressure on the check valve by the fluid in the annulus.

2. The work string of claim 1, wherein the packer is a retrievable packer.

3. The work string of claim 1, wherein the packer is a long term suspension packer.

4. The work string of claim 1, wherein the work string comprises at least two packers to isolate a vertical section of the borehole.

5. The work string of claim 1, wherein the check valve is selected from the group consisting of a ball check valve, a poppet valve, and a diaphragm check valve.

6. The work string of claim 1, wherein the predetermined minimum pressure is between about 15 and about 500 psi.

7. The work string of claim 1, wherein the check valve is operable to prevent a circulation fluid in the work string from flowing into the annulus such that the circulation fluid circulates out an end of the work string and into the annulus below the packer.

8. A method of depressurizing an annulus in a borehole of a well comprising:

providing a work string in the borehole so as to form the annulus around the work string; and depressurizing the annulus by permitting fluid in the annulus to flow through a biased check valve in a sub body of a packer sub below a packer into the work string without fluid type differentiation upon the fluid in the annulus exerting a predetermined minimum pressure on the biased check valve to open the check valve against the bias.

9. The method of claim 8, further comprising removing the fluid in the work string from the borehole by extracting the fluid at the surface.

10. The method of claim 8, further comprising removing the fluid in the work string from the borehole by circulating a circulation fluid down through the work string below the packer sub and into the annulus.

11. The method of claim 10, further comprising forcing the circulation fluid to circulate in the work string below the packer sub by preventing the circulation fluid from flowing from the work string into the annulus through the check valve.

12. The method of claim 11, wherein the circulation fluid is a kill weight fluid.

13. The method of claim 8, further comprising removing the work string from the borehole.

14. The method of claim 8, further comprising shutting in the well.

15. The method of claim 8, further comprising killing the well with a kill weight fluid.

16. The method of claim 8, wherein the predetermined minimum pressure is between about 15 and about 500 psi.

17. A packer sub locatable in a borehole so as to form an annulus around the packer sub, the packer sub comprising a sub body and a biased check valve in the sub body and operable to permit fluid in the annulus to flow into the packer sub and prevent fluid in the packer sub from flowing into the annulus, wherein the biased check valve is operable to open against a bias and permit fluid in the annulus to flow into the packer sub without fluid type differentiation upon exertion of a predetermined minimum pressure on the check valve by the fluid in the annulus.

18. The packer sub of claim 17, wherein the check valve is selected from the group consisting of a ball check valve, a poppet valve, and a diaphragm check valve.

19. The packer sub of claim 17, wherein the predetermined minimum pressure is between about 15 and about 500 psi.

20. The packer sub of claim 17, wherein the check valve is configured to prevent a circulation fluid in the packer sub from flowing through the check valve such that the circulation fluid circulates out an end of the packer sub and into the annulus below the packer.

* * * * *